US010905303B2

(12) United States Patent
Hu et al.

(10) Patent No.: US 10,905,303 B2
(45) Date of Patent: Feb. 2, 2021

(54) WATER TANK ASSEMBLY FOR ROBOT VACUUM CLEANER AND ROBOT VACUUM CLEANER

(71) Applicants: Jiangsu Midea Cleaning Appliances Co., Ltd., Suzhou (CN); Midea Group Co., Ltd., Foshan (CN)

(72) Inventors: Wei Hu, Suzhou (CN); Xianmin Wei, Suzhou (CN)

( * ) Notice: Subject to any disclaimer, the term of this patent is extended or adjusted under 35 U.S.C. 154(b) by 262 days.

(21) Appl. No.: 16/121,665

(22) Filed: Sep. 5, 2018

(65) Prior Publication Data

US 2019/0350428 A1 Nov. 21, 2019

Related U.S. Application Data

(63) Continuation of application No. PCT/CN2018/098019, filed on Aug. 1, 2018.

(30) Foreign Application Priority Data

May 18, 2018 (CN) ..... 2018 2 0746944 U

(51) Int. Cl.
*A47L 11/40* (2006.01)
*A47L 9/00* (2006.01)

(52) U.S. Cl.
CPC ..... *A47L 11/4083* (2013.01); *A47L 9/009* (2013.01); *A47L 11/4072* (2013.01); *A47L 2201/00* (2013.01)

(58) Field of Classification Search
CPC .. A47L 11/4083; A47L 11/4072; A47L 9/009; A47L 2201/00
See application file for complete search history.

(56) References Cited

FOREIGN PATENT DOCUMENTS

| | | | |
|---|---|---|---|
| CN | 203677401 | U | 7/2014 |
| CN | 105619375 | A | 3/2016 |
| CN | 106793899 | A | 5/2017 |
| CN | 206285061 | U | 6/2017 |
| CN | 206852557 | U | 1/2018 |

OTHER PUBLICATIONS

International Search Report dated Dec. 6, 2018 in the corresponding PCT application (application No. PCT/CN2018/098019.

*Primary Examiner* — David Redding
(74) *Attorney, Agent, or Firm* — Kilpatrick Townsend & Stockton, LLP

(57) ABSTRACT

A water tank assembly for a robot vacuum cleaner and a robot vacuum cleaner are provided. The robot vacuum cleaner includes a main unit, two drive wheels and a universal wheel. The water tank assembly includes a water tank and a support part, and the universal wheel and the water tank assembly are disposed to the main unit. When the robot vacuum cleaner is located on a horizontal ground, the universal wheel and the two drive wheels contact the ground, and the support part is spaced from the ground by a preset value. When the robot vacuum cleaner is inclined towards a side where the water tank assembly is, the support part contacts the ground.

14 Claims, 6 Drawing Sheets

WATER TANK ASSEMBLY FOR ROBOT VACUUM CLEANER AND ROBOT VACUUM CLEANER

CROSS-REFERENCE TO RELATED APPLICATION

This application is a continuation of International Application No. PCT/CN2018/098019, filed on Aug. 1, 2018, which claims priority to Chinese Patent Application Serial No. 201820746944.7, filed with the State Intellectual Property Office of P. R. China on May 18, 2018, the entire content of which is incorporated herein by reference.

FIELD

The present application relates to a water tank assembly for a robot vacuum cleaner and a robot vacuum cleaner.

BACKGROUND

Currently, shapes of most robot vacuum cleaners in the market are almost flat (circular or quasi-circular). Due to shape limitation, an internal structure of the robot vacuum cleaner is also a planar expansion arrangement. Therefore, a center of gravity of the robot vacuum cleaner is not always in an ideal position, so as to cause a common imbalance problem of the center of gravity of the flat robot vacuum cleaner, such that the robot vacuum cleaner is prone to skew in a front-rear direction, affecting the use thereof.

With respect to the imbalance problem of the center of gravity, the current solutions are most to add a counterweight block such as an iron block, so as to achieve the purpose of adjusting a center-of-gravity position of the robot vacuum cleaner.

However, the manner to adjust the center of gravity of the robot vacuum cleaner by adding the counterweight block has the following drawbacks: a weight of the whole machine is increased, thereby indirectly influencing use performance of the whole machine, for example, power consumption is increased and endurance time is reduced; a cost of the whole machine is increased, and assembly efficiency of the product is decreased; in the robot vacuum cleaner with a water tank, water volume of the water tank will cause a shift of the center-of-gravity position of the whole machine, which also cause occurrence of the imbalance of the robot vacuum cleaner.

SUMMARY

Thus, an objective of the present application is to provide a water tank assembly for a robot vacuum cleaner so as to address an imbalance problem of the whole machine caused by a shift of a center-of-gravity position of the whole machine due to water volume of a water tank; and to provide a robot vacuum cleaner to address an imbalance problem of a center of gravity of the whole machine caused by an arrangement of internal structures of the robot vacuum cleaner.

For this purpose, an aspect of the present application proposes a water tank assembly for a robot vacuum cleaner. The robot vacuum cleaner includes a main unit, two drive wheels and a universal wheel, and the two drive wheels are disposed at two sides of a center part of the main unit respectively; the water tank assembly includes a water tank and a support part disposed to and protruded from a bottom of the water tank, and the universal wheel and the water tank assembly are disposed to the main unit and located at two sides of a center-connection line of the two drive wheels respectively; when the robot vacuum cleaner is located on a horizontal ground, the universal wheel and the two drive wheels contact the ground, and the support part is spaced from the ground by a preset value; when the robot vacuum cleaner is inclined towards a side where the water tank assembly is, the support part contacts the ground to support the robot vacuum cleaner.

Further, the support part is located at a symmetric center line of the bottom of the water tank, and the support part includes a supporting seat disposed to the bottom of the water tank and a supporting roller mounted to the supporting seat.

Further, the supporting roller is an arc-surface cylindrical structure that has a circular-arc-surface transition at two ends thereof.

Further, the support part is located at a symmetric center line of the bottom of the water tank, and the support part is a spherical-surface boss.

Another aspect of the present application further proposes a robot vacuum cleaner. The robot vacuum cleaner includes a main unit, two drive wheels and a universal wheel, and the two drive wheels are disposed at two sides of a center part of the main unit respectively; in which the robot vacuum cleaner further includes a support part, the universal wheel and the support part are disposed to the main unit and located at two sides of a center-connection line of the two drive wheels respectively; when the robot vacuum cleaner is located on a horizontal ground, the universal wheel and the two drive wheels contact the ground, and the support part is spaced from the ground by a preset value; when the robot vacuum cleaner is inclined towards a side where the support part is, the support part contacts the ground to support the robot vacuum cleaner.

Further, the two drive wheels are symmetrically disposed at two sides of the main unit, the universal wheel and the support part are located in a midperpendicular of the center-connection line of the two drive wheels, and the support part includes a supporting seat disposed to the bottom of the main unit and a supporting roller mounted to the supporting seat.

Further, the supporting roller is disposed in a midperpendicular of the center-connection line of the two drive wheels.

Further, the supporting roller is an arc-surface cylindrical structure that has a circular-arc-surface transition at two ends thereof.

Further, the two drive wheels are symmetrically disposed at two sides of the main unit, the universal wheel and the support part are located in a midperpendicular of the center-connection line of the two drive wheels, and the support part is a spherical-surface boss.

Further, the preset value ranges from 0 to 5 mm.

Further, the preset value is 1 mm.

Further, the main unit includes a base and a water tank detachably mounted on the base, the universal wheel is disposed to the base, and the support part is disposed to the water tank.

In the water tank assembly for the robot vacuum cleaner of the present application, since the support part protruded from the bottom of the water tank is employed, when the robot vacuum cleaner equipped with the water tank assembly is inclined, the support part contacts the ground to support the robot vacuum cleaner, thereby solving the imbalance problem of the center of gravity of the robot vacuum cleaner caused by change of the water volume of the water tank; meanwhile, in the robot vacuum cleaner of the present application, since the support part disposed to the bottom of the main unit is employed, when the robot vacuum cleaner is inclined, the support part contacts the ground to support the robot vacuum cleaner, thereby solving the imbalance problem of the center of gravity caused by the arrangement of the internal structures of the robot vacuum cleaner. Furthermore, compared to the conventional manner that the imbalance of the center of gravity of the robot vacuum cleaner is adjusted by adding a counterweight block, the present application employs the support part manner, which not only reduces production cost of the robot vacuum cleaner, but also lightens the weight of the robot vacuum cleaner.

BRIEF DESCRIPTION OF THE DRAWINGS

The accompanying drawings are used to provide further understanding of embodiments of the present application, constitute a part of the specification, and are intended to explain the embodiments of the present application with the following specific implementations, but do not constitute a limitation to the embodiments of the present application, in which.

DETAILED DESCRIPTION

Figure 1:
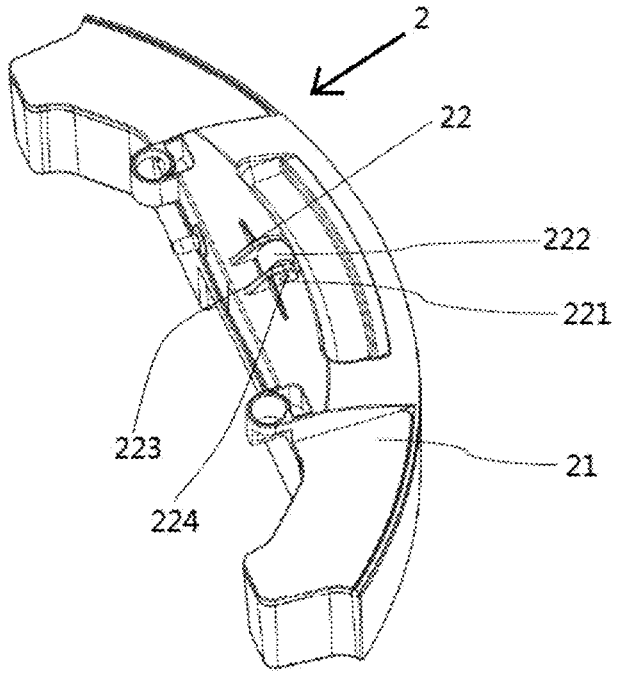
FIG. 1 is a perspective view of a water tank assembly for a robot vacuum cleaner according to the present application.

The specific implementations of embodiments will be described in detail with reference to the accompanying drawings below. It should be understood that, the specific implementations described herein are merely used to illustrate and explain the embodiments of the present application, and are not intended to limit the embodiments of the present application.

According to one embodiment, a water tank assembly 2 for a robot vacuum cleaner 1 is provided. Referring to FIGS. 1 to 5. As shown, the robot vacuum cleaner 1 includes a main unit 11, two drive wheels 12 and a universal wheel 13, and the two drive wheels 12 are disposed at two sides of a center part of the main unit 11. The water tank assembly 2 includes a water tank 21 and a support part 22 disposed to and protruded from a bottom of the water tank 21, and the universal wheel 13 and the water tank assembly 2 are disposed to the main unit 11 and located at two sides of a center-connection line of the two drive wheels 12 respectively. When the robot vacuum cleaner 1 is located on a horizontal ground, the universal wheel 13 and the two drive wheels 12 contact the ground. The support part 22 is spaced from the ground by a preset value. When the robot vacuum cleaner 1 is inclined towards a side where the water tank assembly 2 is, the support part 22 contacts the ground to support the robot vacuum cleaner 1.

It should be noted that, the center part of the main unit 11 may be an exact center part of the main unit 11, and may also a part deviating from the exact center part by a predetermined value. The predetermined value may be considered according to factors such as arrangement of a bottom structure of the main unit 11, design of an initial center-of-gravity position of the whole machine, and so on, which will not be described in detail herein.

Figure 2:
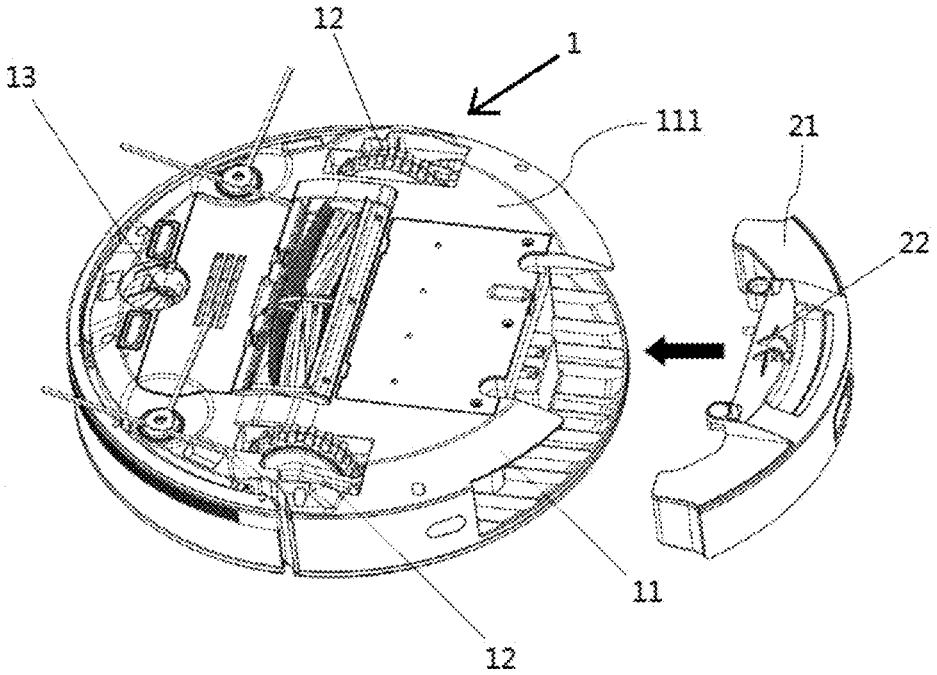
FIG. 2 is a perspective view of a water tank assembly according to the present application before being assembled with a robot vacuum cleaner.
Figure 3:
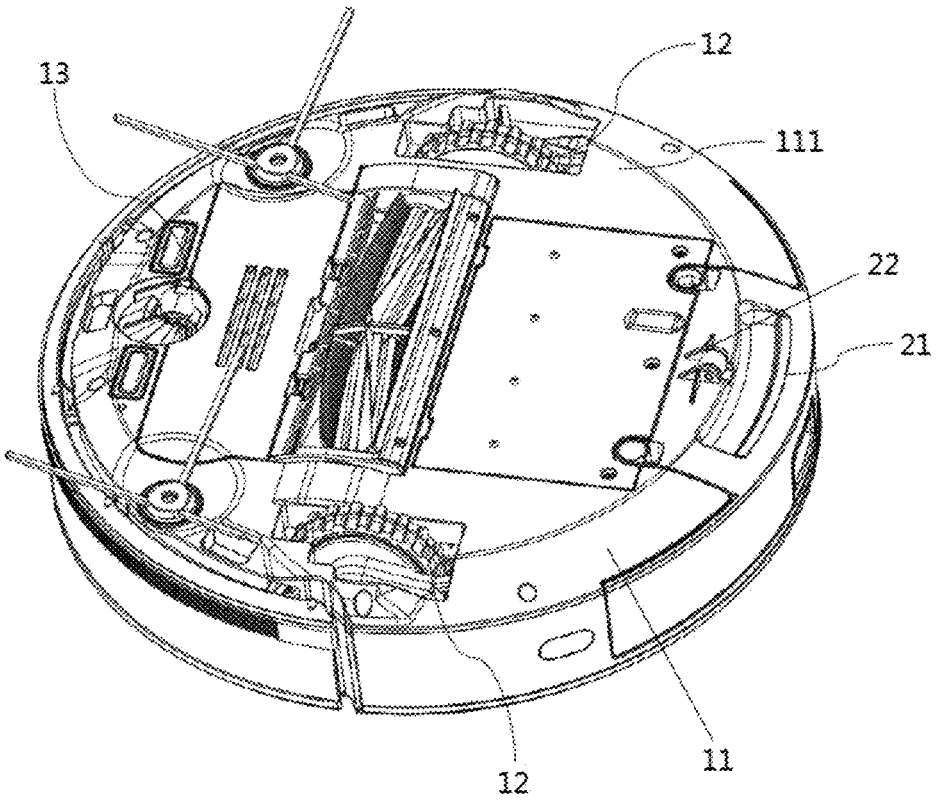
FIG. 3 is a perspective view of a water tank assembly according to the present application after being assembled with a robot vacuum cleaner.
Figure 4:
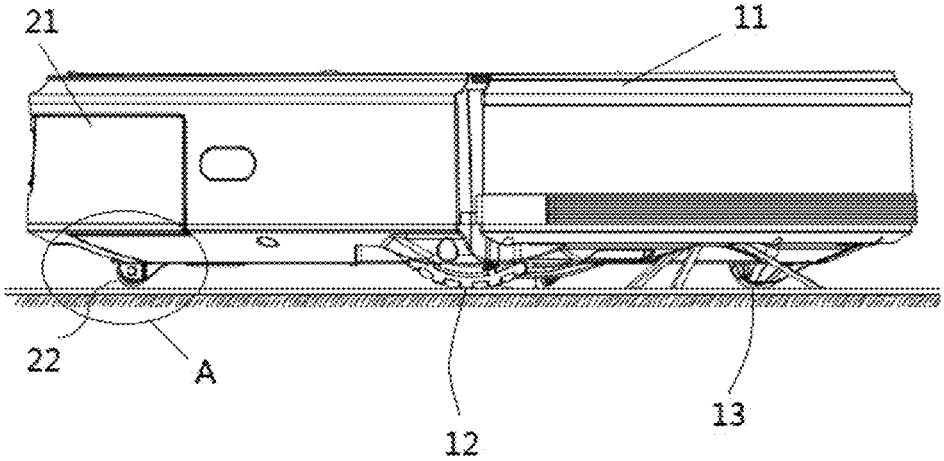
FIG. 4 is a side view of a robot vacuum cleaner according to the present application, being placed on a horizontal ground.

In some embodiments, as illustrated in FIGS. 2 to 4, the robot vacuum cleaner 1 has a flat circular structure, but is not limited to this. The two drive wheels 12 are mounted on a diameter or a chord perpendicular to a forward direction of the robot vacuum cleaner 1.

As illustrated in FIGS. 1 to 3, the support part 22 is located at a symmetric center line of the bottom of the water tank 21, and the support part 22 includes a supporting seat 221 disposed to the bottom of the water tank 21 and a supporting roller 222 mounted to the supporting seat 221. In order to mount the supporting roller 222, the supporting seat 221 includes two connecting plates 223, and the two connecting plates 223 are symmetrically arranged with respect to the symmetric center line of the bottom of the water tank 21, have the same shape, and are spaced apart from each other. Each of the connecting plates 223 has a first end detachably or fixedly connected to the bottom of the water tank 21, and a second end supporting a supporting shaft 224 clamped between the two connecting plates 223. The supporting shaft 224 is perpendicular to the symmetric center line of the bottom of the water tank 21, i.e. parallel to the center-connection line of the two drive wheels 12.

In some embodiments, the supporting roller 222 is an arc-surface cylindrical structure that has a circular-arc-surface transition at two ends thereof. The arc-surface cylindrical structure means that an arc transition occurs between a cylindrical surface of a main body of the supporting roller 222 and two end surfaces of the supporting roller 222. The supporting roller 222 is configured as the arc-surface cylindrical structure, such that a friction force between the supporting roller 222 and the ground during rolling process is reduced, thereby improving flexibility of the supporting roller 222. The supporting roller 222 includes an axial through hole to receive the supporting shaft 224, and thus the supporting roller 222 rotates around the supporting shaft 224. The supporting roller 222 may be made from any material, preferably from plastic, so as to reduce a weight of the robot vacuum cleaner 1.

In other embodiments that are not illustrated, the support part 22 may be a spherical-surface boss. The spherical-surface boss means that the support part 22 is a spherical surface disposed to and protruded from a bottom surface of the water tank 21, so as to reduce a possible friction force. The spherical-surface boss may be made from plastic, so as to reduce the weight of the robot vacuum cleaner 1.

Figure 5:
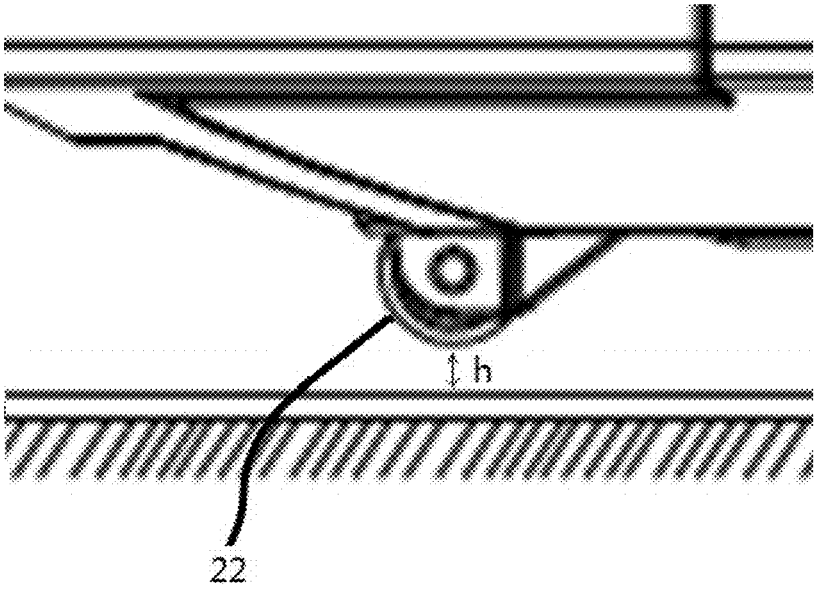
FIG. 5 is a partial enlarged view of part A in FIG. 4.
Figure 6:
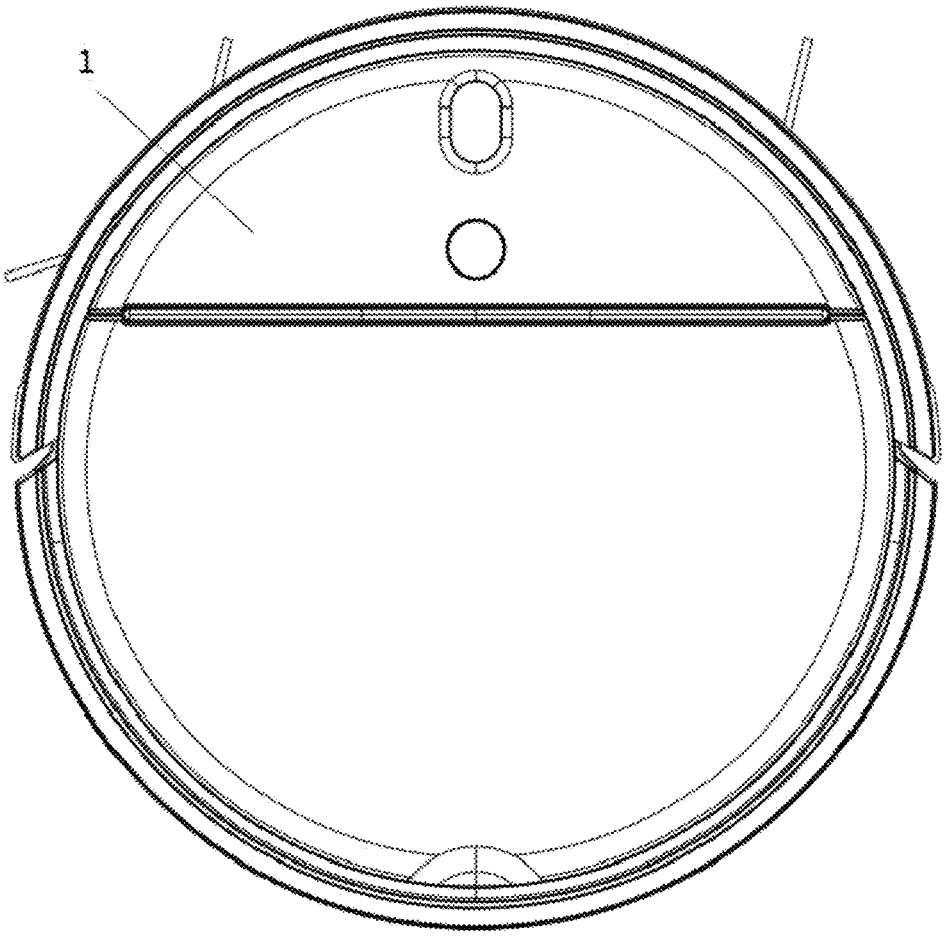
FIG. 6 is a top view of a robot vacuum cleaner according to the present application.

After the water tank assembly 2 is mounted on the main unit 11, with reference to FIGS. 4 to 5, when the robot vacuum cleaner 1 is located on the horizontal ground, the universal wheel 13 and the two drive wheels 12 contact the ground, and the support part 22 is spaced from the ground by a preset value h. The preset value h ranges from 0 to 5 mm. If the preset value h is too large, then the support part 22 cannot have a good supporting effect. If the preset value h is too small, then the support part 22 may frequently contacts the ground, thereby influencing the flexibility of the robot vacuum cleaner during normal traveling. Preferably, the preset value h is 1 mm.

According to a second embodiment of the present application, a robot vacuum cleaner 1 is provided. For convenience of illustration in combination with the drawings, FIGS. 1 to 6 are still referred to, but this is not intended to limit that the robot vacuum cleaner 1 must include the water tank 21. In some other embodiments, the robot vacuum cleaner 1 may have no water tank 21, and in this case, the support part 22 is just disposed to a base 111 of the main unit 11.

Referring to FIGS. 1 to 6, the robot vacuum cleaner 1 includes the main unit 11, the two drive wheels 12 and the universal wheel 13, and the two drive wheels 12 are disposed at two sides of the center part of the main unit 11. The robot vacuum cleaner 1 further includes support part 22. The universal wheel 13 and the support part 22 are disposed to the main unit 11 and located at two sides of the center-connection line of the two drive wheels 12 respectively. When the robot vacuum cleaner 1 is located on the horizontal ground, the universal wheel 13 and the two drive wheels 12 contact the ground, and the support part 22 is spaced from the ground by a preset value. When the robot vacuum cleaner 1 is inclined towards a side of the support part 22, the support part 22 contacts the ground to support the robot vacuum cleaner 1.

It should be noted that, the center part of the main unit 11 may be the exact center part of the main unit 11, and may also be the part deviating from the exact center part by the predetermined value. The predetermined value may be considered according to factors such as the arrangement of the bottom structure of the main unit 11, the design of the initial center-of-gravity position of the whole machine, and so on, which will not be described in detail herein.

In some embodiments, as illustrated in FIGS. 2 to 4, the robot vacuum cleaner 1 is a flat circular structure, but is not limited to this. The two drive wheels 12 are mounted on the diameter or the chord perpendicular to the forward direction of the robot vacuum cleaner 1.

As illustrated in FIGS. 1 to 3, the two drive wheels 12 may be symmetrically disposed at two sides of the main unit 11, and the universal wheel 13 and the support part 22 are located in the midperpendicular of the center-connection line of the two drive wheels 12 and located at two sides of the center-connection line of the two drive wheels 12 respectively. The support part 22 includes the supporting seat 221 disposed to the bottom of the main unit 11 and the supporting roller 222 mounted to the supporting seat 221. In order to mount the supporting roller 222, the supporting seat 221 includes two connecting plates 223, and the two connecting plates 223 are symmetrically arranged with respect to the center part of the main unit 11, have the same shape, and are spaced apart from each other. Each of the connecting plates 223 has the first end detachably or fixedly connected to the bottom of the main unit 11, and the second end supporting the supporting shaft 224 clamped between the two connecting plates 223. The supporting shaft 224 is parallel to the center-connection line of the two drive wheels 12, i.e. perpendicular to the midperpendicular of the center-connection line of the two drive wheels 12.

The supporting roller 222 may be an arc-surface cylindrical structure that has a circular-arc-surface transition at two ends thereof. The arc-surface cylindrical structure means an arc transition occurs between the cylindrical surface of the main body of the supporting roller 222 and two end surfaces of the supporting roller 222. The supporting roller 222 is configured as the arc-surface cylindrical structure, such that the friction force between the supporting roller 222 and the ground during rolling process is reduced, thereby improving the flexibility of the supporting roller 222. The supporting roller 222 includes an axial through hole to receive the supporting shaft 224, and thus the supporting roller 222 rotates around the supporting shaft 224. The supporting roller 222 may be made from any material, preferably from plastic, so as to reduce the weight of the robot vacuum cleaner 1.

In other embodiments that are not illustrated, the support part 22 may be the spherical-surface boss. The spherical-surface boss means that the support part 22 is the spherical surface disposed to and protruded from the bottom surface of the main unit 11, so as to reduce the friction force. The spherical-surface boss may be made from plastic, so as to reduce the weight of the robot vacuum cleaner 1.

When the robot vacuum cleaner 1 is located on the horizontal ground, the universal wheel 13 and the two drive wheels 12 contact the ground, and the support part 22 is spaced from the ground by a preset value h. The preset value h ranges from 0 to 5 mm. If the preset value h is too large, then the support part 22 cannot have a good supporting effect. If the preset value h is too small, then the support part 22 may frequently contacts the ground, thereby influencing the flexibility of the robot vacuum cleaner during normal traveling. Preferably, the preset value h is 1 mm.

Further, the main unit 11 includes the base 111 and the water tank 21 detachably mounted on the base 111, the universal wheel 13 is disposed to the base 111, and the support part 22 is disposed to the water tank 21.

By using the support part 22 instead of the conventional counterweight block, when the robot vacuum cleaner 1 is placed on the horizontal ground, the two drive wheels 12 and the universal wheel 13 form a three-point support with the ground, while the support part 22 does not contact the ground (as illustrated in FIGS. 4 to 5). When the robot vacuum cleaner 1 is inclined towards a side where the support part 22 is, the support part 22 contacts the ground, so as to have the supporting effect to make the robot vacuum cleaner operate normally. Furthermore, when the robot vacuum cleaner 1 turns, the support part 22 may not contact the ground, or if the support part 22 contacts the ground, then the turning of the robot vacuum cleaner 1 is not influenced under the guiding effect of the arc surface or spherical surface transition of the support part 22. Thus, the balance of the robot vacuum cleaner 1 is better maintained.

Embodiments employ the protruded support part 22, thereby solving the imbalance problem of the center of gravity of the robot vacuum cleaner 1. Furthermore, compared to the conventional manner that the imbalance of the center of gravity of the robot vacuum cleaner is adjusted by adding the counterweight block, the support part manner is employed, which not only reduces the production cost of the robot vacuum cleaner 1, but also lightens the weight of the robot vacuum cleaner 1. Meanwhile, the support part 22 will not reduce the flexibility of the robot vacuum cleaner 1. On the contrary, the support part 22 itself can roll or slide, thereby increasing the flexibility of the robot vacuum cleaner 1.

The above-described are merely specific implementations of the present application, but the protection scope of the present application is not limited to this. The conceivable change or alternative by those skilled in the art within the technical scope disclosed by the present application should be covered in the protection scope of the present application.

What is claimed is:

1. A water tank assembly for a robot vacuum cleaner, the robot vacuum cleaner comprises a main body, two drive wheels and a universal wheel, wherein the water tank assembly comprises a water tank and a supporter, the supporter being protruding downwards from a bottom of the water tank and positioned in a centerline of the main body;

wherein the universal wheel and the water tank assembly are disposed to the main body, and located at opposite sides of a center-connection line of the two drive wheels;

wherein when the robot vacuum cleaner is positioned on a horizontal ground, the supporter is spaced from the ground by a preset value while the universal wheel and the two drive wheels contact the ground; and when the robot vacuum cleaner inclines towards the water tank assembly, the supporter contacts the ground to support the robot vacuum cleaner.

2. The water tank assembly according to claim 1, wherein the supporter is located at a symmetric center line of the bottom of the water tank, and the supporter comprises a supporting seat disposed at the bottom of the water tank and a supporting roller mounted to the supporting seat.

3. The water tank assembly according to claim 2, wherein the supporting roller includes an arc-surface cylindrical structure having a circular-arc-surface transition at two ends thereof.

4. The water tank assembly according to claim 1, wherein the supporter is located at a symmetric center line of the bottom of the water tank, and the supporter has a spherical shape protruding from the bottom of the water tank assembly.

5. A robot vacuum cleaner, comprising a main body, a water tank, a supporter, two drive wheels and a universal wheel, wherein the universal wheel and the water tank are disposed to the main body and located at opposite sides of a center-connection line of the two drive wheels, the supporter protrudes downwards from a bottom of the water tank and is positioned in a centerline of the main body;

when the robot vacuum cleaner is positioned on a horizontal ground, the supporter is spaced from the ground by a preset value while the universal wheel and the two drive wheels contact the ground; and when the robot vacuum cleaner inclines towards the water tank, the supporter contacts the ground to support the robot vacuum cleaner.

6. The robot vacuum cleaner according to claim 5, wherein the two drive wheels are symmetrically disposed at two sides of the main body, the universal wheel and the supporter are located in a midperpendicular of the center-connection line of the two drive wheels, and the supporter comprises a supporting seat disposed to the bottom of the main body and a supporting roller mounted to the supporting seat.

7. The robot vacuum cleaner according to claim 6, wherein includes an arc-surface cylindrical structure having a circular-arc-surface transition at two ends thereof.

8. The robot vacuum cleaner according to claim 5, wherein the two drive wheels are symmetrically disposed at two sides of the main body, the universal wheel and the supporter are located in a midperpendicular of the center-connection line of the two drive wheels, and the supporter has a spherical shape.

9. The robot vacuum cleaner according to claim 5, wherein the preset value ranges from 0 to 5 mm.

10. The robot vacuum cleaner according to claim 9, wherein the preset value is 1 mm.

11. The robot vacuum cleaner according to claim 5, wherein the main body comprises a base and a water tank detachably mounted on the base, the universal wheel is disposed to the base, and the supporter is disposed to the water tank.

12. A robot vacuum cleaner, comprising a main body, a water tank, a supporter, two drive wheels and a universal wheel, wherein the universal wheel and the water tank are disposed to the main body and located at opposite sides of a center-connection line of the two drive wheels, the supporter protrudes downwards from a bottom of the water tank and is positioned in a centerline of the main body, and the supporter comprises at least an arc surface, wherein a lowest point on the arc surface is higher than a lowest point of the universal wheel when the robot vacuum cleaner is on a horizontal ground.

13. The robot vacuum cleaner according to claim 12, wherein a diameter of the supporter is less than a diameter of the universal wheel.

14. The robot vacuum cleaner according to claim 12, wherein the supporter comprises a supporting seat disposed at the bottom of the water tank and a supporting roller mounted to the supporting seat.

* * * * *